US005568177A

United States Patent [19]

Talvalkar et al.

[11] Patent Number: 5,568,177

[45] Date of Patent: Oct. 22, 1996

[54] THERMAL TRANSFER PRINTING RIBBON FOR PRINTING SECURITY BAR CODE SYMBOLS

[75] Inventors: Shashi G. Talvalkar, Kettering; Marion E. McCreight, West Carrollton, both of Ohio

[73] Assignee: AT&T Global Information Solutions Company, Dayton, Ohio

[21] Appl. No.: 415,276

[22] Filed: Apr. 3, 1995

[51] Int. Cl.[6] ..... B41J 31/05; B41J 31/08

[52] U.S. Cl. ..... 347/217; 347/221

[58] Field of Search ..... 347/217, 221; 400/237; 428/195, 329, 900, 913, 914, 692

[56] References Cited

U.S. PATENT DOCUMENTS 5,047,291 9/1991 Talvalkar et al. ..... 428/329

*Primary Examiner*—Huan H. Tran

*Attorney, Agent, or Firm*—Craig E. Miller

[57] ABSTRACT

Thermal transfer printing ribbon for printing security bar code symbols wherein the thermal transfer printing ribbon has been overprinted or overcoated in specific predetermined locations with a coating which has magnetic recognition characteristics. The difference in printed bar code symbols is invisible to the human eye and bar-code scanning equipment, but can be readily detected using a device capable of recognizing a magnetic signal.

18 Claims, 3 Drawing Sheets

THERMAL TRANSFER PRINTING RIBBON FOR PRINTING SECURITY BAR CODE SYMBOLS

BACKGROUND AND SUMMARY OF THE INVENTION

The present invention relates generally to new and novel improvements in thermal transfer printing ribbon for printing security bar code symbols. More particularly, the present invention relates to thermal transfer printing ribbon for printing security bar code symbols, particularly useful for reducing fraudulent transactions and product returns and enhancing security for retailers and similar businesses.

Bar code scanners and bar code symbols identifying merchandise have experienced greatly increased usage and acceptance in retail establishments over the past decade. Considerable advancements have been made in automation, data recognition and information processing technology for checkout counters in supermarkets and similar retail establishments. With these advances in technology, serious concerns have arisen to minimize the loss of revenue due to fraudulent transactions and product returns. Major retailers have estimated annual losses in the order of millions of dollars due to such fraudulent transactions and product returns.

Steps have been taken to tighten security and to verify receipts when items are returned to a store. Examples of such security measures include the addition of fluorescent materials in inks used to print receipts which can be subsequently verified using an ultraviolet lamp and preprinted and logo printed receipt rolls which are difficult to reproduce. While these techniques have enhanced security for retailers to some extent, further improvement is desirable.

Accordingly, an object of the present invention is the provision of thermal transfer printing ribbon for printing security bar code symbols with unique identifying features which would be difficult to reproduce.

Another object of the present invention is to provide thermal transfer printing ribbon for printing security bar code symbols which are invisible to the human eye, and thus undetectable by visual inspection.

Yet another object of the present invention is to provide thermal transfer printing ribbon for printing security bar code symbols which are printed using thermal transfer ribbon on conventional thermal transfer bar code printers.

These and other objects of the present invention are attained by the provision of thermal transfer printing ribbon for printing security bar code symbols wherein the thermal transfer printing ribbon has been overprinted or overcoated in specific predetermined locations with a coating which has magnetic recognition characteristics. The difference in printed bar code symbols is invisible to the human eye and conventional bar-code scanning equipment, but can be readily detected using a device capable of recognizing a magnetic signal.

Other objects, advantages and novel features of the present invention will become apparent in the following detailed description of the invention when considered in conjunction with the accompanying drawings.

DETAILED DESCRIPTION OF THE DRAWINGS

Figure 1A:
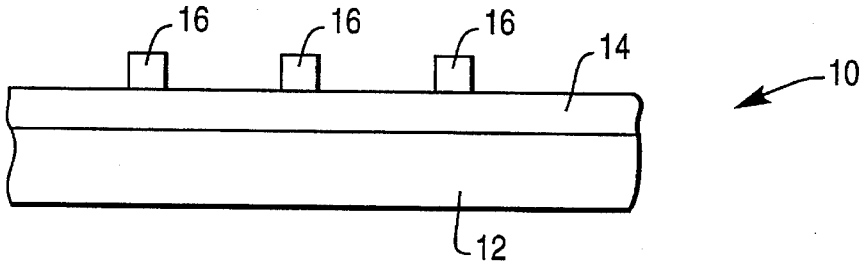
FIG. 1A is a cross sectional side view and FIG. 1B is a top view of a thermal transfer printing ribbon for printing security bar code symbols in accordance with a preferred embodiment of the present invention.
Figure 1B:
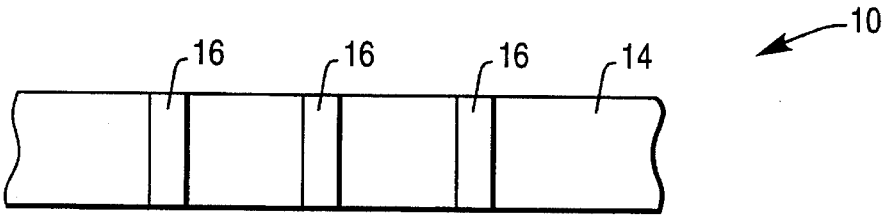

Referring now to the drawings, in which like-referenced characters indicate corresponding elements throughout the several views, attention is first directed to FIGS. 1A and 1B which illustrates a cross-sectional side view and a top view of a preferred embodiment of a thermal transfer printing ribbon for printing security bar code symbols, generally identified by reference numeral 10. Thermal transfer printing ribbon for printing security bar code symbols 10 generally includes base or substrate 12, preferably a thin, smooth, tissue-type or polyester-type plastic, first visible coating layer 14 and second magnetic recognition characteristics coating layer 16. Base or substrate 12 of the polyester-type plastic is in the range of 14 to 75 gauge polyester, polyethylene, polypropylene or like material. First visible coating layer 14 is a typical thermal transfer printing ribbon formulation such as AD-12430. Second magnetic recognition characteristics coating layer 16 is overcoated with AD-12734 which has magnetic iron oxide dispersed in the coating. In thermal transfer printing ribbon for printing security bar code symbols 10, second magnetic recognition characteristics coating layer 16 is approximately ¼ or ⅜ inches in width.

Figure 2:
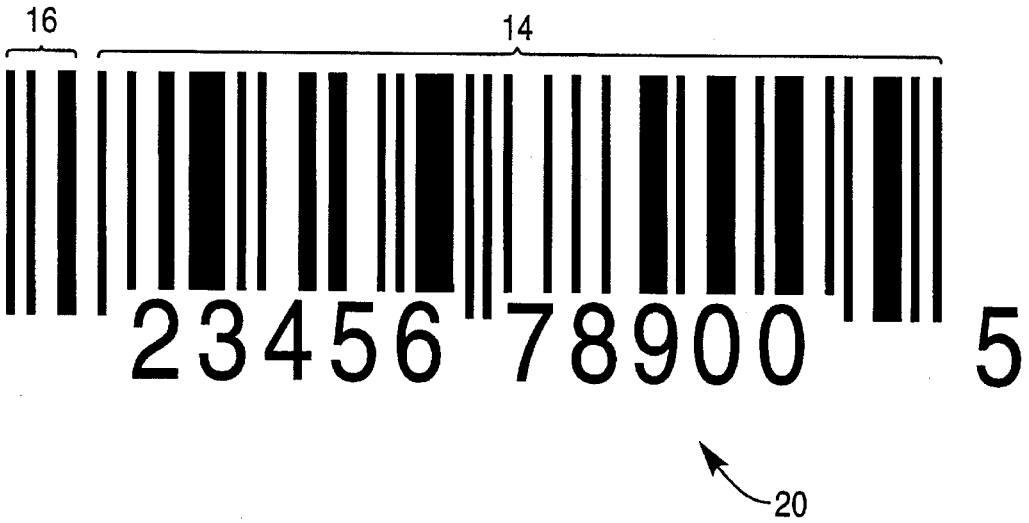
FIG. 2 illustrates a security bar code symbol where the left three bars have a magnetic iron oxide dispersed with the carbon black and the remaining bars are carbon black only without the dispersed magnetic iron oxide printed using the thermal transfer printing ribbon shown in FIGS. 1A and 1B.
Figure 3:
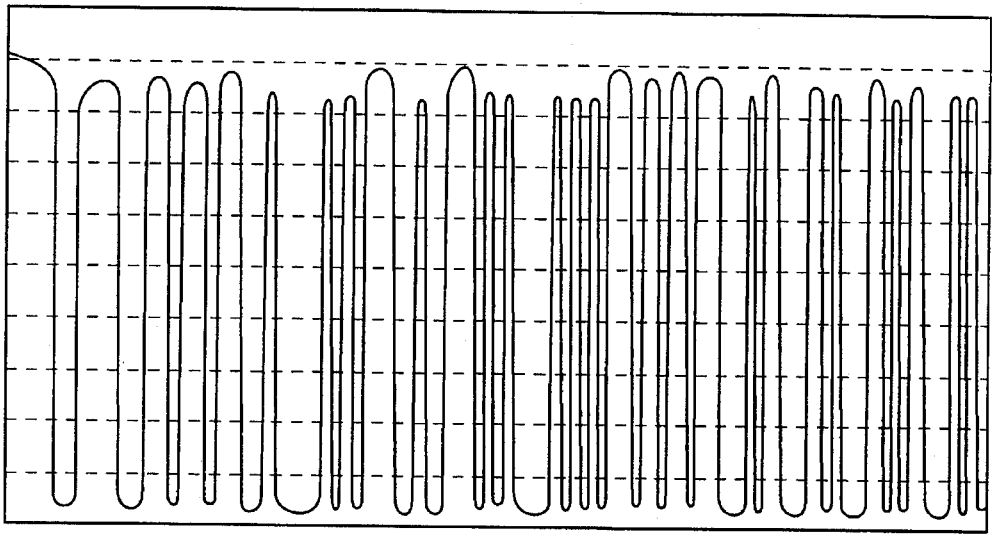
FIG. 3 is a printout showing the reflectance density of the bars in the security bar code symbol shown in FIG. 2 printed using the thermal transfer printing ribbon shown in FIGS. 1A and 1B.

Referring to FIG. 2, security bar code symbol 20 was printed using thermal transfer printing ribbon for printing security bar code symbols 10 shown in FIGS. 1A and 1B using a conventional thermal transfer bar code printer. Since all bars in security bar code symbol 20 are black, there is no visual difference in the individual bars of printed security bar code symbol 20. Furthermore, no significant difference in the measurements of reflectance or PCS values of security bar code symbol 20 as measured by bar-code scanners which decode bar code symbols by comparing the difference in reflectance was detected as shown in the chart of reflectance density of the bars in security bar code symbol 20 as shown in the chart in FIG. 3. The measurements shown in FIG. 3 were made using "Inspector IV" manufactured by RJS.

Figure 4:
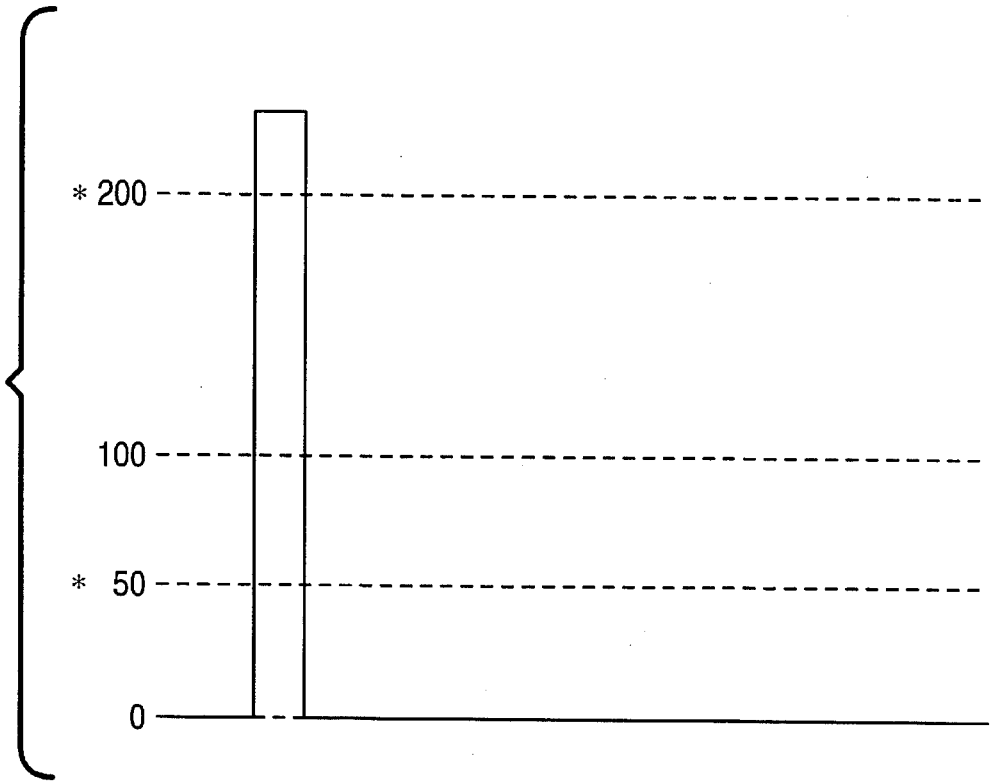
FIG. 4 is a printout showing the magnetic signal of the bars in security bar code symbol shown in FIG. 2 printed using the thermal transfer printing ribbon shown in FIGS. 1A and 1B showing that a magnetic signal is detected in the area where the left three bars having magnetic iron oxide are printed and the right side of the bar code symbol having no magnetic iron oxide shows no magnetic signal.

However, when security bar code symbol 20 is analyzed using a magnetic character recognition reader, a high magnetic signal is observed in the left three or four bars, as shown in FIG. 4.

Figure 5A:
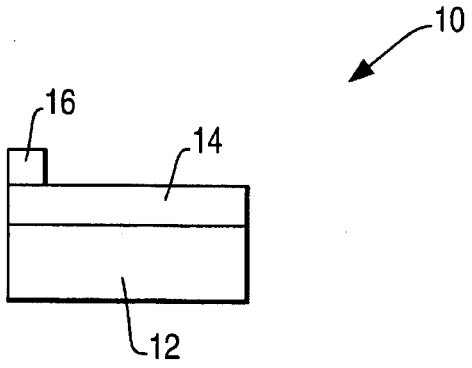
FIG. 5A shows an end view and FIG. 5B shows a top view of a thermal transfer printing ribbon for printing security bar code symbols in accordance with another embodiment of the present invention.
Figure 5B:
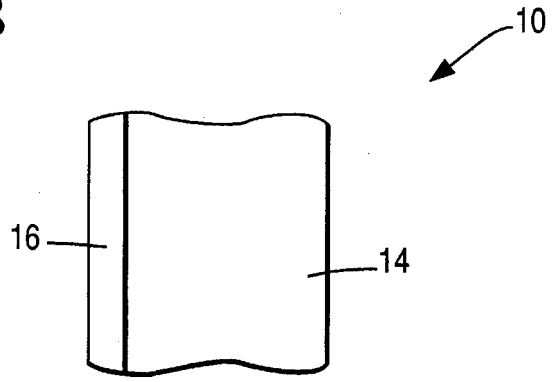
Figure 6:
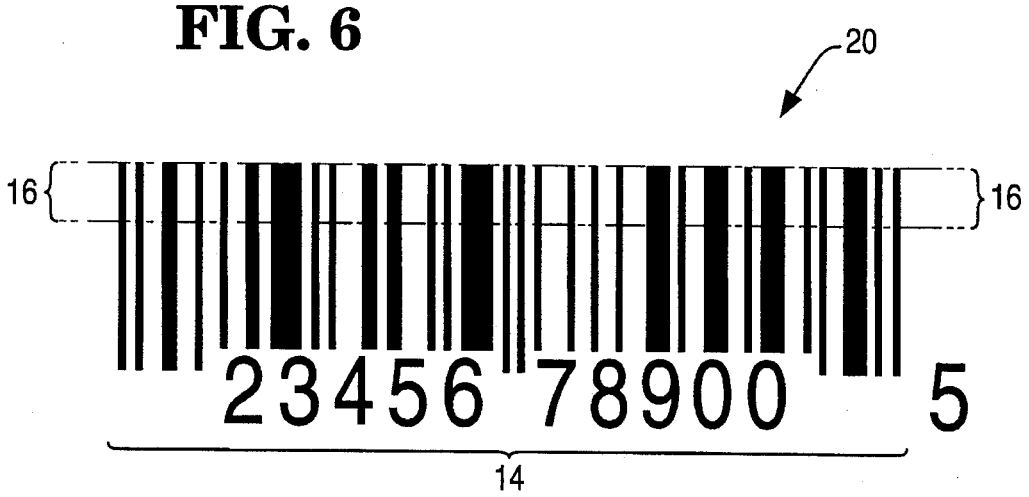
FIG. 6 illustrates a security bar code symbol where a horizontal stripe portion of all the bars have a magnetic iron oxide dispersed with the carbon black and the remaining portion of the bars are carbon black only without the dispersed magnetic iron oxide printed using the thermal transfer printing ribbon shown in FIGS. 5A and 5B.

Thermal transfer printing ribbon for printing security bar code symbols 10 can be fabricated by overprinting specific areas of the first visible coating layer 14 with zones of second magnetic recognition characteristics coating layer 16 including a magnetic iron oxide or chromium oxide dispersed therein. The zones of second magnetic recognition characteristics coating 16 can constitute narrow stripes as shown in the preferred embodiment of the present invention in FIGS. 1A and 1B, or may be wider stripes or of other desired sizes and configurations. For example, as shown in FIGS. 5A and 5B horizontal stripes of second magnetic recognition characteristics coating layer 16 could be overcoated on thermal transfer printing ribbon for printing security bar code symbols 10 so that any portion of security bar code symbol 20 could be magnetically detected dependent on the width and location of the second magnetic recognition characteristics coating layer 16 stripe in the printed security bar code symbol 20. FIG. 6 shows a printed security bar code printed using thermal transfer printing ribbon for printing security bar code symbols 10 shown in FIGS. 5A and 5B.

Furthermore, the size, location and configuration of second magnetic recognition characteristics coating layer 16 within security bar code symbol 20 can be changed at predetermined time intervals, such as every day if desired, to provide additional security. In such a case, the size, location and configuration of second magnetic recognition characteristics coating layer 16 within security bar code symbol 20 can be compared with the "correct" size, location and configuration of second magnetic recognition characteristics coating layer 16 within security bar code symbol 20 for the date printed on the receipt to detect and preclude fraudulent transactions or product returns.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A thermal transfer printing ribbon for printing security bar code symbols, comprising:

a base having a top surface;

a first visible coating layer adhered to said top surface of said base, said first visible coating layer having a top surface; and a second magnetic recognition characteristics coating layer adhered to said top surface of said first visible coating layer.

2. The thermal transfer printing ribbon for printing security bar code symbols in accordance with claim 1, wherein said second magnetic recognition characteristics coating layer is overcoated over predetermined portions of said top surface of said first visible coating layer.

3. The thermal transfer printing ribbon for printing security bar code symbols in accordance with claim 2, wherein said base is a polyester-type plastic.

4. The thermal transfer printing ribbon for printing security bar code symbols in accordance with claim 2, wherein said second magnetic recognition characteristics coating layer is overcoated over a series of vertical stripes of said top surface of said first visible coating layer.

5. The thermal transfer printing ribbon for printing security bar code symbols in accordance with claim 4, wherein each of said series of vertical stripes are approximately ¼ inches in width.

6. The thermal transfer printing ribbon for printing security bar code symbols in accordance with claim 4, wherein each of said series of vertical stripes are approximately ⅜ inches in width.

7. The thermal transfer printing ribbon for printing security bar code symbols in accordance with claim 2, wherein said second magnetic recognition characteristics coating layer is overcoated over a continuous horizontal stripe of said top surface of said first visible coating layer.

8. The thermal transfer printing ribbon for printing security bar code symbols in accordance with claim 2, wherein said second magnetic recognition characteristics coating layer includes a dispersion of iron oxide.

9. The thermal transfer printing ribbon for printing security bar code symbols in accordance with claim 4, wherein said second magnetic recognition characteristics coating layer includes a dispersion of iron oxide.

10. The thermal transfer printing ribbon for printing security bar code symbols in accordance with claim 2, wherein said second magnetic recognition characteristics coating layer includes a dispersion of chromium oxide.

11. The thermal transfer printing ribbon for printing security bar code symbols in accordance with claim 4, wherein said second magnetic recognition characteristics coating layer includes a dispersion of chromium oxide.

12. A security bar code symbol, comprising a plurality of vertical bars, wherein a predetermined portion of said security bar code symbol less than the entire security bar code symbol has magnetic recognition characteristics which are detectable by a device capable of detecting a magnetic signal.

13. The security bar code symbol in accordance with claim 12, wherein said predetermined portion of said security bar code symbol having magnetic recognition characteristics which are detectable by a device capable of detecting a magnetic signal are a plurality of vertical printed bar code bars.

14. The security bar code symbol in accordance with claim 12, wherein said predetermined portion of said security bar code symbol having magnetic recognition characteristics which are detectable by a device capable of detecting a magnetic signal consists of three to four vertical printed bar code bars.

15. A security bar code, comprising a plurality of vertical bars, wherein a predetermined portion of said security bar code symbol has magnetic recognition characteristics which are detectable by a device capable of detecting a magnetic signal and wherein said predetermined portion is a horizontal stripe extending across a portion of said plurality of vertical bars.

16. A security bar code symbol, comprising a plurality of vertical bars, wherein a first portion of said vertical bars have magnetic recognition characteristics which are detectable by a device capable of detecting a magnetic signal and a second portion of said vertical bars do not have magnetic recognition characteristics and are not detectable by a device capable of detecting a magnetic signal.

17. The security bar code symbol in accordance with claim 16, wherein said first portion are a plurality of vertical printed bar code bars.

18. The security bar code symbol in accordance with claim 16, wherein said first portion consists of three to four vertical printed bar code bars.

* * * * *